United States Patent [19]

Culotta et al.

[11] Patent Number: 4,584,925

[45] Date of Patent: Apr. 29, 1986

[54] UNDERWATER ROCKET LAUNCHER AND ROCKET PROPELLED MISSILE

[76] Inventors: Kenneth W. Culotta; Anthony J. Culotta, both of 1141 Willa Vista Trail, Maitland, Fla. 32751

[21] Appl. No.: 535,814

[22] Filed: Sep. 26, 1983

[51] Int. Cl.[4] ..... F41B 11/10; F41C 1/00; F41C 9/06; F41F 3/04

[52] U.S. Cl. ..... 89/1.807; 42/1 L; 89/1.809; 102/275; 102/371; 102/374; 102/380

[58] Field of Search ..... 89/1.819, 1.816, 1.814, 89/1.812, 1.807, 1.809, 1.8; 102/371, 374, 247, 272, 275, 498, 445, 380; 42/1 L

[56] References Cited

U.S. PATENT DOCUMENTS

| | | | |
|---|---|---|---|
| 2,436,396 | 2/1948 | McCaslin | 102/272 |
| 2,496,316 | 2/1950 | Skinner et al. | 89/1.807 |
| 3,300,888 | 1/1967 | Belcher et al. | 42/1 L |
| 3,324,767 | 6/1967 | Alban | 42/1 L X |
| 3,444,778 | 5/1969 | Bates | 89/1.816 X |
| 3,453,763 | 7/1969 | Barr et al. | 42/1 L X |
| 3,580,172 | 5/1971 | Hendricks | 102/371 |
| 3,616,561 | 11/1971 | Hendricks | 42/1 L |
| 3,618,244 | 11/1971 | Johnson | 102/371 X |
| 3,842,711 | 10/1974 | Bodinaux | 89/1.807 |
| 3,871,120 | 3/1975 | Mounier | 42/1 L |
| 3,893,366 | 7/1975 | Murray | 89/1.807 X |
| 4,038,902 | 8/1977 | Welsh | 89/1.807 |
| 4,128,039 | 12/1978 | Skliris | 89/1.814 X |
| 4,266,358 | 5/1981 | Phillips et al. | 42/1 L X |

FOREIGN PATENT DOCUMENTS

| | | | |
|---|---|---|---|
| 1066458 | 10/1959 | Fed. Rep. of Germany | 89/1.807 |
| 2252215 | 5/1974 | Fed. Rep. of Germany | 42/1 L |

*Primary Examiner*—David H. Brown

*Attorney, Agent, or Firm*—Julian C. Renfro

[57] ABSTRACT

Our invention comprises a launcher which takes the form of a holster carried firearm and a rocket propelled missile slidably mounted within the launcher. Features of our invention include electrical ignition of the rocket propelled missile, waterproof electrical connectors and switches, an impact actuated warhead, a warhead firing mechanism, electrical and mechanical safety devices, and automatic warhead arming upon rocket motor ignition. Additional features include rapid reload capability, illuminated sight lights, ease of carry and one hand operation. Our design incorporates only two moving parts in the launcher, and one moving part sealed within the missile body. Advantageously, none of the components are subject to corrosion or contamination, and no special materials are necessary in its fabrication.

22 Claims, 13 Drawing Figures

UNDERWATER ROCKET LAUNCHER AND ROCKET PROPELLED MISSILE

BACKGROUND OF THE INVENTION

The purpose of our invention is to deliver an impact actuated warhead to an underwater target, such as a fish, at greater ranges than has been previously possible. As such, prior art exists in two major areas. These are the means for the underwater projection of a warhead to some distance from the launch point, and the means for actuating the warhead upon encountering the target.

In the first area, the prior art consists of devices which expend a major part of their propulsive energy while the warhead and its carrying projectile are in contact with the launching device. Typical examples are spear guns propelling a projectile by means of stored energy in an elastic band, compressed gas, chemical reaction, or springs. Range for these prior art devices depends on projectile mass, drag, and launch velocity. It can be shown by those familiar with differential equations that the velocity (V) of a projectile is given by $$V = \frac{Vo}{Vo\left(\frac{\rho C_D A}{2m}\right) t + 1} \quad (Fps)$$

where Vo is the initial launch velocity (Fps), t is time (sec), $\rho$ is the density of water $$\left(\frac{\#\text{-sec}^2}{\text{Ft}^4}\right),$$

$C_D$ is the projectile drag coefficient, A is the projectile reference area ($Ft^2$) and m is the projectile mass $$\left(\frac{\#\text{-sec}^2}{\text{Ft}}\right).$$

By assuming some typical projectile characteristics, we can examine typical ranges for prior art devices. These are summarized as follows:

Drag coefficient $C_D=0.25$

Initial velocity Vo=50 Fps.

Reference area A=0.00545 Ft.$^2$ $$\text{Water density } \rho = 2\frac{\# - \text{sec}^2}{\text{ft}^4}$$

Impact velocity for warhead firing=15 Fps.

Projectile mass m=0.0155

Solving Equation (1) for time (t) where V=15 Fps (the impact velocity) yields a flight time of 0.53 sec. The average velocity over this time is about 30 Fps yielding and approximate range of about 15 Ft. The argument can be made to increase Vo (initial velocity) to increase range but with increasing launch velocity, recoil forces become very large. For an 18" projectile weighing ½ pound as in the above example, the acceleration required to achieve a 50 Fps launch velocity is 833 Ft/sec$^2$. This yields a minimum average launch recoil force of 13 pounds with a peak force of about twice this value. Increasing launch velocity to 100 Fps yields a peak recoil force of over 100 pounds with a range increase to about 37 Ft. Thus, prior art devices such as spear guns are limited in range because of large recoil forces. There is a prior art in an underwater gun with minimal recoil, issued on June 13, 1967 as U.S. Pat. No. 3,324,767. That particular invention reduces recoil by reacting recoil forces on a rearwardly sliding mass. The disadvantages of that invention are the requirement for a relatively thick barrel to contain high pressure gas, the sliding parts which can become fouled, the use of a separate cartridge and projectile, and reload time.

There is a prior art in an underwater gun issued under U.S. Pat. No. 3,580,172 on May 25, 1971. That invention is limited in range to the length of the thrust pole employed.

Our invention relies on the prior art of rocket propulsion in general. It is well known to those skilled in the art of rocket propulsion that recoil forces are negligible during projectile launch when the rocket motor exhaust gases are not contained in the launch device. Also great range can be achieved because the propulsive energy is expended along the flight path of the rocket rather than all at once in the launcher as in the case with prior art "gun" type devices. For the particular application of rocket propulsion to project an underwater projectile at a fish, no prior art was found.

For a given amount of propulsive impulse and a given configuration, range R is inversely proportional to the product of the average drag force $F_D$ and flight time $t_F$ as given by $$R \sim [1/(F_D \times t_F)]$$

The average drage force $F_D$ is proportional to the square of the average velocity $\overline{V}$, and flight time $t_F$ is inversely proportional to $\overline{V}$. This yields $$R \sim (1/\overline{V})$$

which states that range is inversely proportional to the average flight velocity. The lower the average flight velocity, the greater the range.

For maximum range, the average velocity must be kept as low as possible. Missiles which expend all their propulsive impulse in the launcher have high initial velocities which decay to some final velocity at their maximum effective ranges. Missiles powered by a rocket motor which do not expend all propulsive impulse in the launcher have lower initial velocities which can either decay or rise to final velocity at their maximum effective range. These rocket propelled missiles have lower average velocities and therefore greater range than those which expend their energy within the launcher.

The advantages over the prior art on using rocket propulsion to propel a projectile to an underwater target can be summarized as follows:

1. The launcher and projectile can be made small in size with low cost materials, and no machining operations.
2. There is negligible recoil and no range limitation other than that imposed by the total impulse provided by a particular rocket motor.
3. There are a low number of moving parts (exclusive of springs, there are two moving parts in our launcher and one in our projectile).
4. The projectile is disposable.

5. Reload time is very rapid.

In the second area of prior art concerning the impact actuation of the warhead, there are several inventions for discussion. In U.S. Pat. No. 3,871,120 issued Mar. 18, 1975 entitled "Gun Barrel and Firing Mechanism for Impact-Actuated Underwater Guns" there is described an invention for the purpose of killing large fish, such as sharks. The essence of that invention consists of a detonating plunger attached to a thrust member such as a pole or spear shaft. The detonating plunger slides within a sleeve to which is attached a gun barrel containing a cartridge. To the detonating plunger, a firing pin is attached which is held separate from the cartridge primer by means of a helical spring. In operation, thrusting against a target such as a large fish causes the detonating plunger to slide within the sleeve, compressing the helical spring, and allowing the firing pin to contact the cartridge primer thereby discharging the cartridge and propelling a projectile.

A disadvantage of that invention is that all the internal sliding parts are exposed to water which requires the use of corrosion resistant materials or coatings for the exposed parts. The components of that invention are also costly owing to the number of machined surfaces. Another disadvantage is that when a powered launch technique such as compressed air, elastic, or an explosion is employed, the launch acceleration force tends to cause the plunger to slide within the sleeve and contact the cartridge primer unless the helical spring is made strong enough to resist these forces. However, this is the same spring that must be compressed upon impact to cause this cartridge to fire. Thus, high acceleration powered launch requires higher impact velocity for that invention to operate. A further disadvantage is that a safety pin must be physically pulled to allow the invention to operate. Once pulled, the invention is "armed" even though it has not been launched. Similar disadvantages exist with the impact actuated firing mechanism issued in U.S. Pat. No. 3,300,888, Jan. 31, 1967 titled "Underwater Gun".

The nearest applicable prior art to the rocket propelled projectile and impact actuated firing mechanism of our invention is described in U.S. Pat. No. 3,580,172, Jan. 25, 1971 titled "Underwater Projectile for Firing a Cartridge Upon Impact". The prior art mentioned the use of rocket propulsion on line 24 of column 2 and described a projectile for firing a cartridge upon impact. The projectile consisted of coaxial head and body parts, the head part defining a gun bore having an open aft end for insertion of an ammunition cartridge, the body part having a sliding firing pin which contacts the cartridge primer upon projectile impact with a target. In the preferred embodiment, the slide was free to move in the body without restraint. A modification to the projectile is also described whereas a pliable material which has a central aperture of smaller diameter than the firing pin diameter is used to physically prevent the firing pin from contacting the cartridge primer with sufficient force for cartridge detonation should the projectile be accidentally tipped.

A deficiency in the prior embodiments so described is that a propulsive force imparted to the projectile will cause the slide to position itself at the extreme end of its travel away from the cartridge. As soon as the propulsive force diminishes to a level which is less than projectile drag force, the slide will move forward due to its own inertia against the primer or the pliable blocking material. In this position, a very large momentum change is necessary to fire the cartridge. The firing pin should have a standoff distance from the cartridge primer because compliant flesh "gives" between one and two inches at impact. This is a non-obvious embodiment contained in our invention which is accomplished by a tension spring which holds the slide away from the cartridge during projectile deceleration prior to impact.

Another deficiency with the prior art is that the firing pin slide as described will act as a piston on impact, compressing the air between the cartridge base and firing pin slide which impedes slide motion. Our invention contains a ventilated slide with air passage holes in the slide thereby equilibrating pressure on both ends of the slide. An argument can be made that the inertial slide diameter can be made smaller than the internal bore of the body allowing air passage around the slide. However, our experiments have shown that when a rotating projectile is used such as in our invention, the slightest mass offset from the centerline of the projectile produces inflight accuracy problems.

Yet another deficiency with that prior art is the possibility of accidental discharge in the event the projectile is dropped rather than tipped. Dropping the projectile produces similar momentum changes as underwater impact with a target and a serious safety issue emerges with that prior art. As will be seen hereinafter, our invention contains many advantages over these prior art devices.

FIELD OF INVENTION

Our invention relates to an underwater weapon for use against large fish and more particularly to a hand held weapon which discharges a high velocity rocket propelled missile or projectile containing a warhead to greater ranges than heretofore possible with negligible weapon recoil.

SUMMARY OF THE INVENTION

Prior art devices for underwater personal protection have used underwater guns which are deficient in range or require recoil absorbing mechanisms. Some are time consuming to assemble or reload, deficient in safety provisions, contain critical and close fitting sliding parts which are exposed to contaminants, and are unwieldy to carry and manipulate underwater.

The safety of a diver would be greatly enhanced if means were available for destroying the largest of underwater marauders at distances greater than a few arm lengths. Requirements for such means include reliability, accuracy, ease of carry, rapid deployment and reload, and safety.

Accordingly, it is an object of our invention to provide a novel underwater weapon which delivers a warhead to an underwater target with great range, velocity, accuracy and safety.

Another object is to provide an underwater weapon which projects a warhead to a great distance without necessitating recoil absorbing devices.

Yet another object is to provide an underwater weapon which has a small number of moving parts, none of which is close fitting or subject to contamination.

It is also an object to provide an underwater weapon which can be easily carried on the person of a diver, is rapid to employ and reload, safe to operate, easily maneuverable, and can be armed and fired with one hand in low light level conditions.

Still another object is to provide an underwater weapon which is easy to maintain in operable condition, and which has a reusable waterproof electrical connection between the missile and launcher.

Also, another object is to provide an impact actuated warhead firing mechanism which reduces the impact velocity required for warhead initiation, enhances safety, and reduces the impedance of sliding parts.

The previously mentioned objects are obtained in accordance with our invention by the provision of an underwater weapon comprising a warhead carrying missile powered by the principle of rocket propulsion, and a hand held launcher through which the missile is discharged. The weapon takes the form of a hand gun which is carried in a holster.

Our underwater rocket propelled missile, its components, and design meet the objectives of carrying a warhead to an underwater target with great range, velocity, accuracy and safety in addition to freedom from contamination. Great range and velocity are achieved through the use of rocket propulsion, and accuracy is achieved through fin and spin stabilization in addition to a special missile nose design.

The fins can provide spin to the missile by canting the fins with respect to the missile body as was done in our preferred embodiment, or alternately, we can use angled fin tabs. Missile spin can also be provided within the launcher by twist in whatever means are employed for guiding the missile from its launcher.

With a particular type of impact actuated warhead, safety is enhanced through a novel use of the rocket motor for freeing the warhead firing mechanism. Our design does not need the external removal of a safety pin for warhead arming. Arming does not occur until rocket motor firing. All internal parts of our missile are sealed and not subject to corrosion or contamination, and construction is of low cost materials, resulting in an expendable missile.

Our underwater rocket launcher, its components, and design meet the objectives of freedom from recoil, rapidity of employment and reload, safety, maneuverability, personal carry, one hand operation, low light level sighting, and easy maintenance. Freedom from recoil is provided by ample openings to relieve gas pressure during launch, and low light level operation is facilitated throught the use of illuminated sights. Electrical operation provides for a minimum of moving parts and increased reliability.

An electrical connector, components of which are contained in the rocket launcher and rocket propelled missile, provide electrical communication between batteries in the rocket launcher and an electric rocket motor igniter in the rocket propelled missile and provides the objects for minimizing the number of moving parts, waterproofing, reusability, safety, and rapid reload.

Further objects and advantages of our invention will become apparent from a consideration of the drawings and reading of our inventions's description and operation.

DESCRIPTION OF THE PREFERRED EMBODIMENTS

The preferred embodiments illustrated are not intended to be exhaustive or to limit our invention to the precise forms disclosed. They are chosen and described in order to best explain the principles of our invention and its application and practical use to thereby enable others skilled in the art to best utilize the invention.

Figure 1:
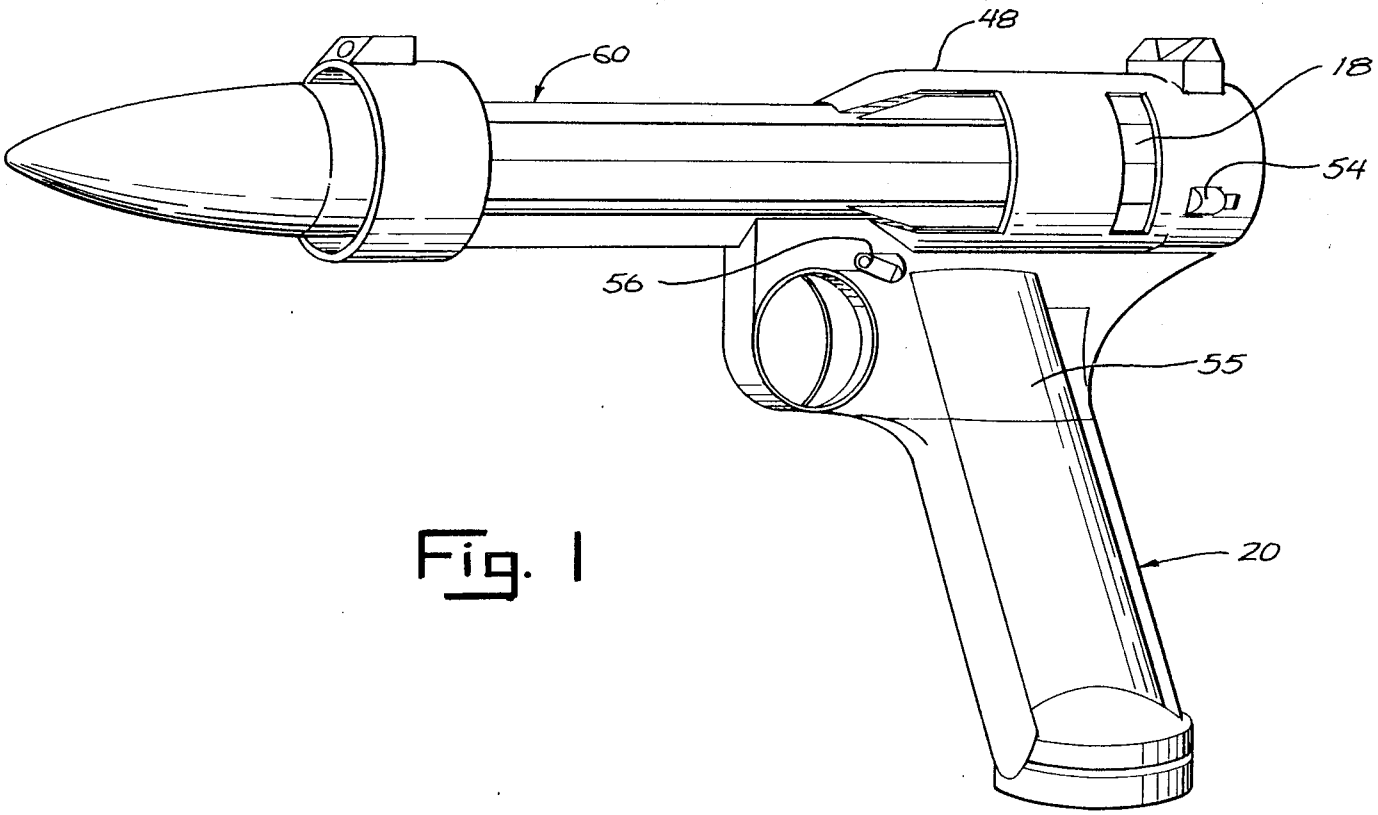
FIG. 1 is a perspective view of the preferred embodiment of our invention.

The major components of our invention are illustrated in FIG. 1. These are an underwater rocket propelled missile generally referred to as 60, and an underwater hand held rocket launcher 20, generally referred to as a pistol-like device. Some externally viewed embodiments are a safe/arm switch slide 54, a removable handle section 55 with latch 56 for access to the handle's internal devices, and a fin guard 48 with exhaust gas ventilation ports 18. The handle section 55 is retained at its lower edge to the rocket launcher by means of a keyed recess, and the latch 56 retains the upper edge.

Figures 2, 3:
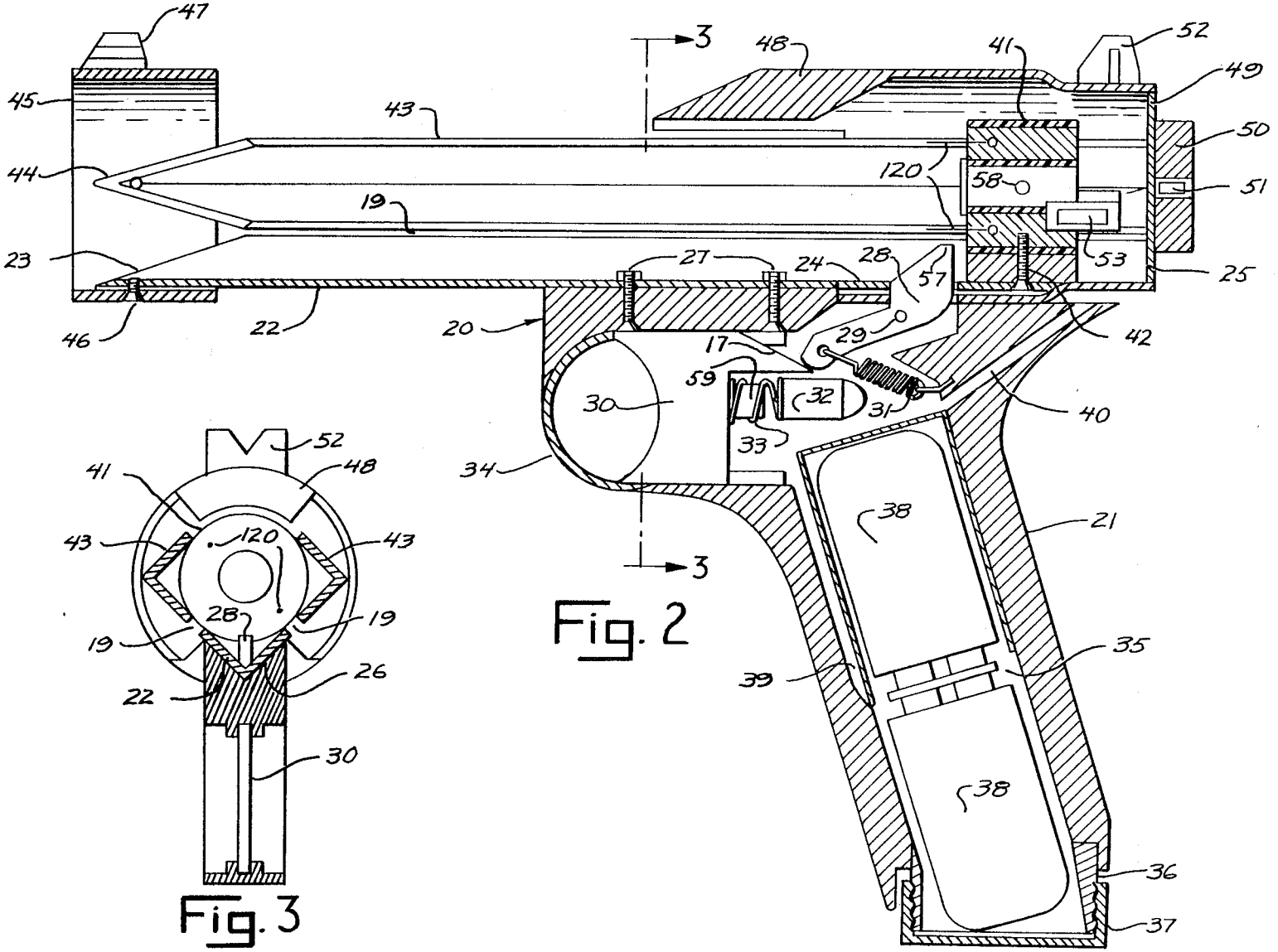
FIG. 2 is a side elevational view of the rocket launcher, with portions removed to reveal internal design, components, and construction.
FIG. 3 is a section view taken along line 3—3 of FIG. 2.

FIG. 2 shows a preferred embodiment of the underwater rocket launcher portion 20 of our invention. The rocket launcher 20 will be seen to comprise a hollow handle, mechanical and electrical devices for missile launching, missile guide rails, a male electrical connector, a safe/arm switch, front and rear sights which are illuminated, an electrical test light, and various other components for the assembly and operation of these previously stated elements.

More specifically, underwater rocket launcher 20 comprises a hollow handle 21 preferably constructed of metal, to which is attached a short member of angular cross section 22, referred to hereinafter as a lower guide rail 22. The lower guide rail is generally horizontal, with a beveled distal end 23, and a slot 24 at the vertex of the lower guide rail, near its proximal end 25. The lower guide rail 22 rests in a V-groove 26 (see FIG. 3)

provided in the upper surface of handle 21. Attachment of the lower guide rail 22 to the handle 21 is preferably by means of machine screws 27, and the guide rail may be of metal or plastic construction.

Extending through the lower guide rail slot 24, as best seen in FIG. 2, is a pivoting part preferably made of plastic, and referred to hereinafter as the missile restraint/release cam 28. This cam is mounted on a pin 29 attached to the handle 21, and about this pin, the cam pivots. One end of the missile restraint/release cam 28 is rounded and slides on a beveled end 17 of trigger 30, which trigger is slidable within handle 21. Providing protection to trigger 30 is a trigger guard 34 attached to handle 21 and preferably made of metal. The other end of missile restraint/release cam 28 is beveled with a horizontal flat 57, which engages a notch in the proximal end of the missile 60, in order to retain the missile in the launcher. This notch and missile 60 will be further described hereinafter. Tension spring 31 holds the rounded end of the said missile restraint/release cam 28 against the beveled end 17 of trigger 30.

Figure 8:
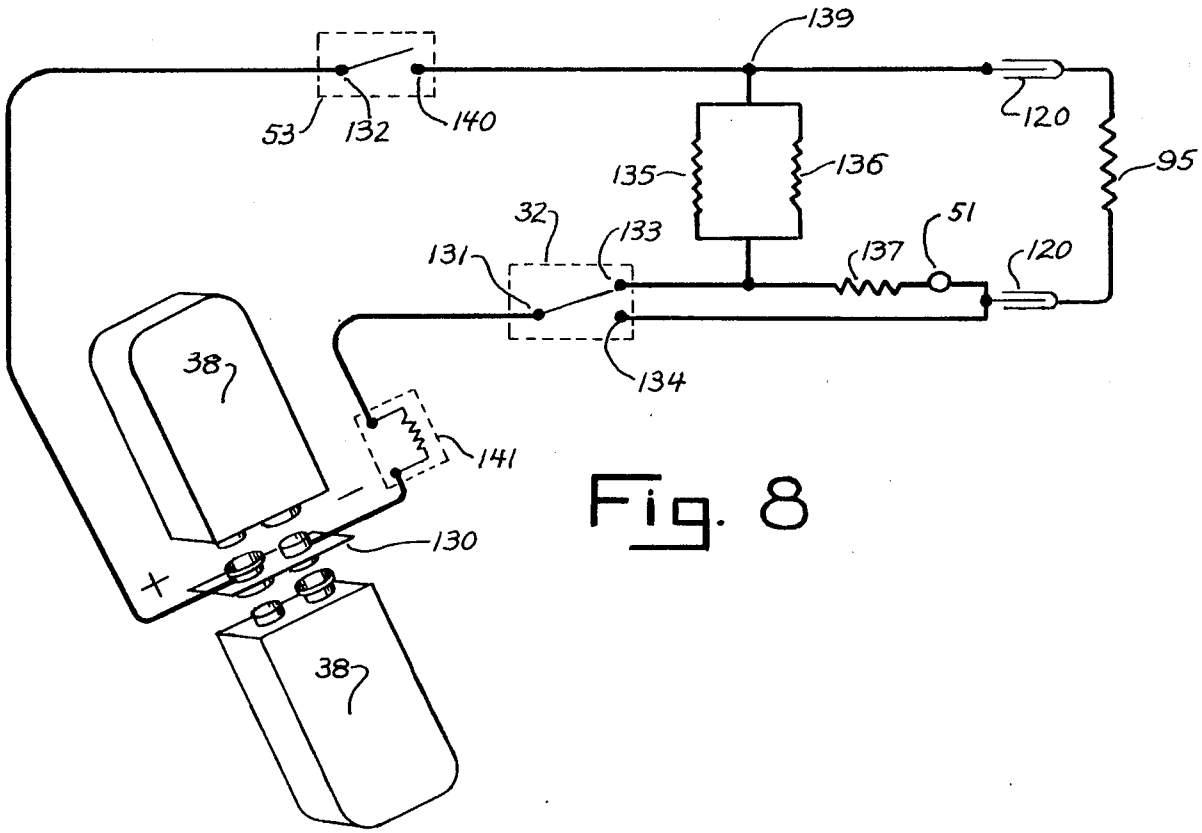
FIG. 8 is a wiring diagram which reveals details of the electrical circuits within the rocket launcher and rocket propelled missile.

Continuing with FIG. 2, the trigger 30 also communicates with a hermetically sealed firing switch 32 and is held separate from the firing switch by spring 33. The switch 32 is held in place by a recess in handle 21 shaped to the switch cross section, and by an opposing, similarly shaped recess on the interior portion of handle section 55 shown in FIG. 1. A small, rectangular extension 59 on the back of trigger 30 holds the spring 33 in alignment with switch 32, and it is this extension which depresses a circuit-closing plunger on this switch when the trigger is pulled. The length of trigger rectangular part 59 is such that upon the user pulling the trigger 30, the rounded end of cam 28 rides up along the beveled end 17 of the trigger, thereby rotating the cam clockwise about the pivot 29, to bring about disengagement of cam flat 57 from a notch 103 in the missile body; see FIG. 6. This disengagement occurs just prior to the rectangular part 59 of the trigger 30 contacting the plunger on switch 32, to actuate the switch. This insures missile release before rocket motor firing. The switch 32 can be one of many types commercially available, and for our preferred embodiment, we selected a hermetically sealed type manufactured by Micro Switch USA, Model No. MS27994-1. The electrical connections are depicted in FIG. 8.

Also contained in the hollow handle 21 is a watertight rectangular compartment 35, best seen in FIG. 2. This compartment 35 has a rectangular cross section, and which transitions to an open circular cross section with external threads 36, which are located at the bottom of the handle 21. Mating to the threads 36 is a threaded cap 37, forming a watertight sealed end to handle 21. The watertight compartment 35 encloses batteries 38, which electrically communicate with the firing switch 32 by appropriate wiring. Passageways 39 and 40 are provided for routing electrical wires, which for clarity are not shown in this figure. Electric wire pass-throughs and sealant are also not shown for reasons of clarity.

A cylindrical part called the male electrical connector 41 is attached to the proximal end of the lower guide rail 22 by means of a machine screw 42. Details of the male connector part 41 and its connector pins 120 are further described hereinafter.

Also attached to the male electrical connector 41 are two short angular cross section members referred to as side guide rails 43. One guide rail 43 is located on one side of the male electrical connector 41 and in line with the lower guide rail 22, whereas the other guide rail is located on the opposite side of connector part 41; see FIG. 3. The three guide rails are in parallelism, and the guide rail 43 positioning is such as to form longitudinal slots 19 with sufficient clearance to allow the missile fins 62 to freely pass when the missile 60 is inserted into the launcher 20. These slots are visible in FIG. 3, and the fins are visible in FIG. 4. The distal ends 44 of both side guide rails 43 are beveled, and attachment to the male electrical connector 41 occurs near the proximal ends of the side guide rails 43, where they are attached by means of machine screws 58 to the connector 41. The side guide rails 43 may be of metal or plastic, and our preferred embodiment employs teflon coated aluminum for the guide rail means, including the two side guide rails 43, and the lower guide rail 22.

As will be seen hereinafter, the guide rails are configured and arranged to assure a proper orientation of the rocket missile for proper mechanical and electrical connections with the pistol-like rocket launching device.

A guide rail support 45 consisting of a circular plastic or metal ring holds the guide rails 43 and 22 in alignment at their distal ends, and guide rail attachment to the guide rail support ring 45 is preferably accomplished by means of machine screws 46. An illuminated front blade sight 47 is fixed to the top of the guide rail support ring 45.

Figure 4:
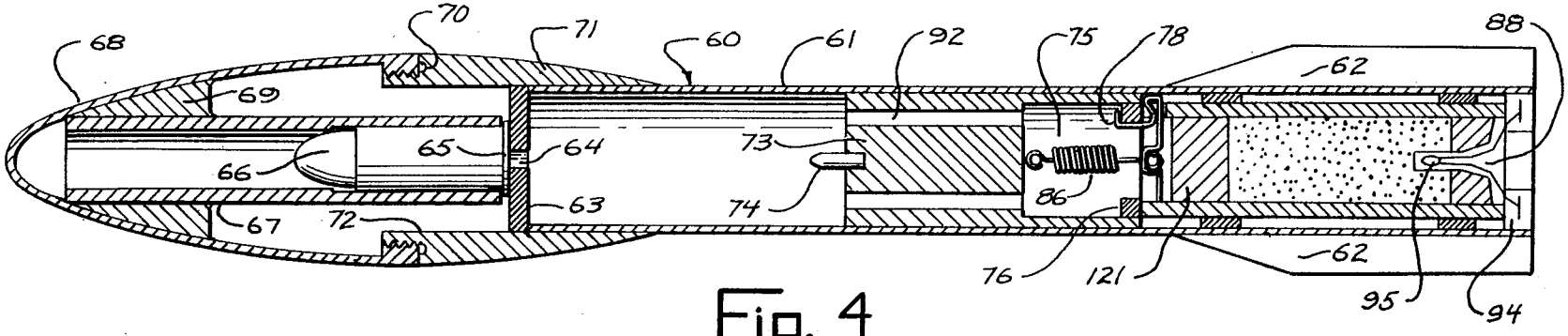
FIG. 4 is a side elevational view of the rocket propelled missile, which reveals internal design, construction, and components.

Slidably affixed to the proximal ends of the guide rails is a hollow cylinder, referred to as a fin guard 48. The guard 48 can be made of plastic or metal and prevents damage to the fins 62 of the rocket propelled missile 60, which are best seen in FIG. 4. In addition, the guard 48 serves to prevent damage to the connector pins 120. The proximal end of the fin guard 48 is covered by an aluminum disc 49 to which is attached an aluminum cylinder 50, which contains an electrical circuit test light 51. The purpose of the test light 51 is to provide an indication that electrical continuity exists between the male connector part 41 and the rocket propelled missile 60.

An illuminated open rear sight 52 is attached to the top of the fin guard 48. A waterproof safe/arm switch 53 is attached to the side of the male connector part 41, and an opening is provided on the side of the fin guard 48 opposite the switch, to which is mounted a switch slide 54; this switch slide is visible in FIG. 1. Until slide 54 is moved to the "arm" position thereby closing switch 53, there is no chance for the missile to fire. When moved to the "arm" position, this switch brings about illumination of front and rear gunsights, which is a desirable feature in low light conditions. Safe/arm switch 53 used in our preferred embodiment is also a hermetically sealed type, and is manufactured by Micro Switch USA, Model No. MS27216-1. Many other commercial types could also be employed.

Turning now to FIG. 4, we there show a preferred embodiment of the underwater rocket propelled missile part of the invention generally referred to as 60. The missile will be seen to comprise a bulbous nose, a missile body with fins, a warhead, an impact actuated firing mechanism, a device for restraining the mechanism, a rocket motor, and a female electrical connector part.

More specifically, the rocket propelled missile 60 includes a thin wall hollow cylinder body 61 preferably of anodized aluminum or plastic tubing to which stabilizing fins 62 providing missile in-flight rotation and stability are attached at the proximal end of said body.

As previously mentioned, the fins can provide spin to the missile by canting the fins with respect to the missile body as was done in our preferred embodiment, or alternately, we can use angled fin tabs. Missile spin can also be provided within the launcher by twist in whatever means are employed for guiding the missile from its launcher. The distal end opening of the body 61 is covered with a steel disc 63 which has a coaxial aperture 64 slightly smaller in diameter than the primer 65 of ammunition cartridge 66. The cartridge 66 fits into a seamless steel tube 67 forming the warhead to which is coaxially bonded a nose cap 68 with epoxy resin 69. The nose cap 68 forms the front portion of the missile 60 bulbous nose, and screwed to the nose cap with an O-ring seal 70 is a boat tail part 71 forming the aft section of the bulbous nose. The boat tail 71 part has an open coaxial bore 72 of a diameter equal to the outer diameter of body 61, and the body is inserted through the bore and attached to the boat tail part with an adhesive bond. The nose cap 68 and boat tail part 71 are preferably of molded plastic.

The missile body 61 contains an inertial mass 73 preferably of circular cross section, which slides within body 61 and with diameter slightly smaller than the inner diameter of said body. For clarity, the diameter differences are not shown in FIG. 4. A firing pin 74 of slightly smaller diameter than the disc aperture 64 is coaxially fixed to the inertial mass 73, and said pin is of length such that it communicates with and fires the primer 65 when the forward face of the inertial mass 73 contacts the disc 63.

Figure 5:
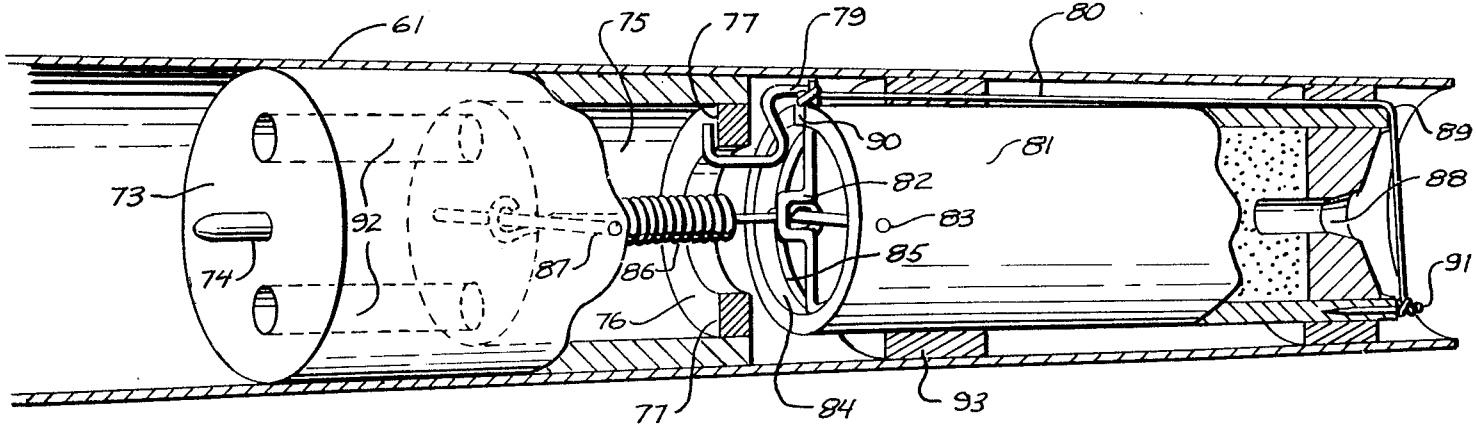
FIG. 5 is a fragmentary cut away perspective view of the missile aft end which reveals details of the warhead initiation mechanism.

As shown in FIGS. 4 and 5, the inertial mass 73 has a cylindrical cavity 75 at the end opposite the firing pin 74 and vent holes 92 equilibrate pressure between the forward face of the inertial mass and its cavity. A steel disc 76 having an outer diameter equal to that of the cylindrical cavity 75 and having a coaxial aperture of diameter less than the disc outer diameter is coaxially bonded to the cavity walls so as to form a flush rear face with inertial mass 73 and an internal shoulder 77. A spring steel wire 78 with an end bent to engage the shoulder 77 acts as an inertial mass 73 restraint, to prevent premature movement of same.

A short distance from the wire 78 bent end, a wire loop 79 is formed to which is tied a line 80, preferably of nylon, such as a 50 pound test fishing line. A recess 90 is provided in the forward end of the rocket motor 81 case to accept the wire loop 79. The wire 78 continues past the loop 79 and runs along the forward end of the rocket motor 81, where it makes four in-plane 90° bends 82 in order to clear retaining pin 83. On the inside of the cylindrical recess 84 in the forward end of the rocket motor 81, the wire 78 is bent into a circle 85 with diameter the same as that of the said cylindrical recess. An aperture exists in the forward end of the rocket motor 81, and wire 78 is retained to said rocket motor by means of a pin 83 passing through said aperture in front of said wire circle 85. The pin 83 also engages one end of tension spring 86, with the other end of this spring being retained by pin 87 at the forward face of the cylindrical cavity 75, with latter pin passing through an aperture in the inertial mass 73. Tension spring 86 is optional, and may be omitted by providing a suitable spring constant to wire 78.

The line 80 tied to the wire loop 79 runs longitudinally along the rocket motor 81, between the said rocket motor outer case and the body 61. As shown in FIG. 5, the line 80 is turned 90° such that it passes directly in front of the rocket motor nozzle 88 and is held in position by a groove 89 at the rear of the rocket motor 81 case. After the line 80 is pulled tight such that the wire loop 79 rests in the recessed groove 90 with the bent end of wire 78 (see FIG. 4) engaging and latching the inertial mass 73 by means of shoulder 77, this line is tied to pin 91 on the aft face of the rocket motor 81 case. The pin 91 is diametrically opposite groove 89.

The rocket motor 81 with attached and latched inertial mass 73 is coaxially positioned and bonded within the body 61 at its proximal end, with a recess at the proximal end of the body of sufficient depth to allow a flush face at the proximal end of said body when the female connector part 94 (see FIG. 4) is added. Spacers 93 may be added to coaxially align the rocket motor 81 with the centerline of the missile 60 should the said rocket motor diameter be less than the body 61 inner diameter.

The rocket motor 81 can be any of several types which are commercially available and employed in model rocketry. An example would be model D20 manufactured by Flight Systems Inc., 9300 East 68th Street, Raytown, Mo. 64133. An electrical rocket motor igniter 95 is inserted into the rocket motor 81 through the rocket motor nozzle 88. In our preferred embodiment, we have used an igniter commercially available from Estes Industries, Penrose, Colo. 81240. Other types are also available.

The model rocket motors normally have an ejection charge at their forward ends which is ignited at motor burnout. In the embodiment shown herein, we use an epoxy plug 121 to prevent the ejection charge gas from entering the rocket body after motor burnout; see FIG. 4. An alternate embodiment would not add the plug 121, and the rocket motor ejection charge could be used to drive the inertial mass 73 forward, thereby initiating the impact actuated warhead just after rocket motor burnout without having the missile 60 impact the target. Additional design modification for this action would entail removing the vent holes in inertial mass 73, and adding vent holes in disc 63 to relieve pressure between the disc 63 and forwardly moving inertial mass. The empty volume in the nose cone 68 would be used as an accumulator for the compressed air which passes through the disc holes.

Figure 6:
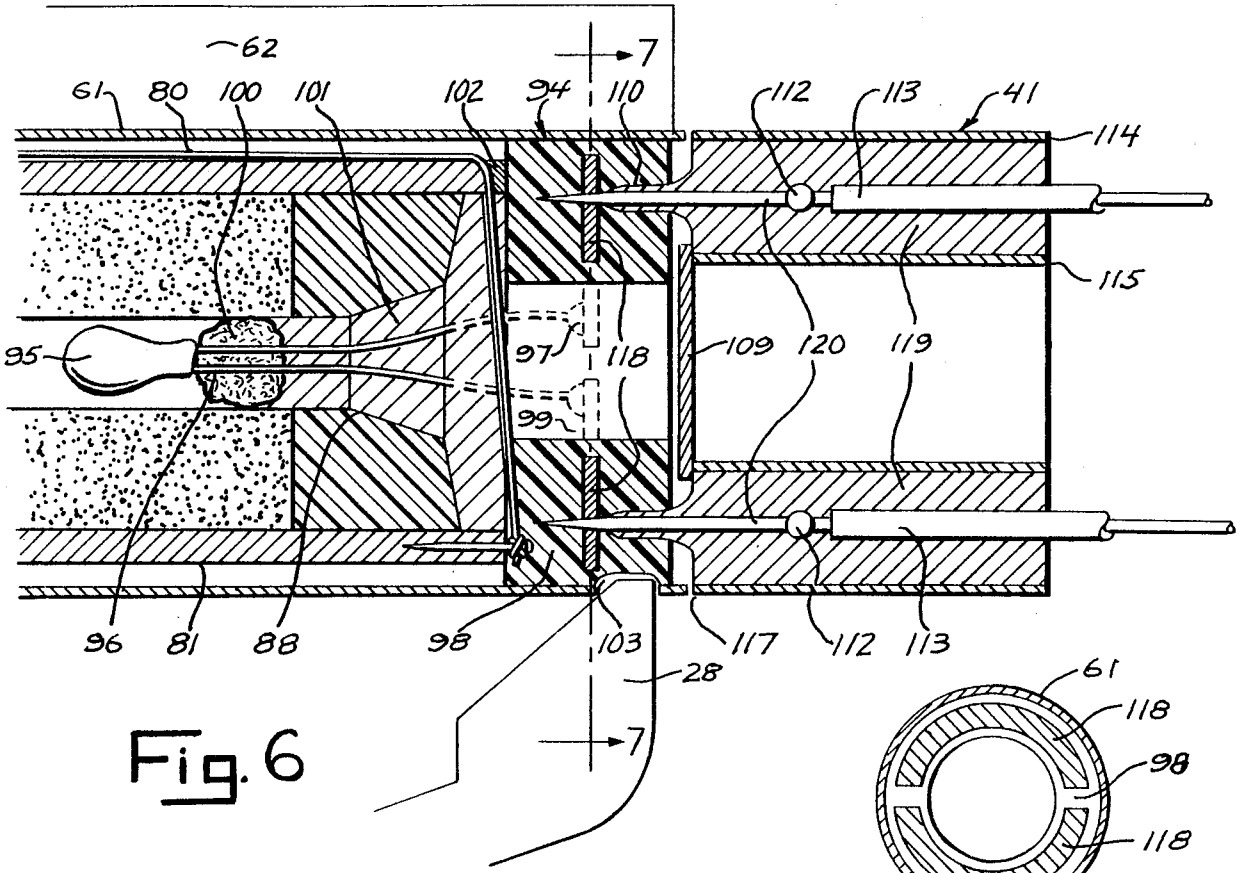
FIG. 6 is a fragmentary side elevational view of the male and female electrical connector which reveals the components, design, and construction details.

Referring to FIG. 6, the electrical connection between the missile 60 and launcher 20 is made by mating two connector parts; a female connector part generally referred to as 94 at the proximal end of the missile 60, and a male connector part generally referred to as 41 near the proximal end of the launcher 20. Referring to the male connector part 41, FIG. 6 shows a preferred embodiment of part 41 to consist of two diametrically opposite pointed stainless steel pins 120 each connected by solder 112 to an insulated electrical wire 113, and the means for rigidly holding the pins separate from each other. For this preferred embodiment, the means consist of a short aluminum tube 114 concentrically surrounding a similar length aluminum tube 115 of smaller diameter. The pins 120 extend from the aluminum tube faces 117 to the extent that they are able to pierce the wire mesh 118 within the female connector part 94 when the male 41 and female connector parts are mated. The annular space between the tubes 114 and 115 is filled with a rigid insulating material 119 such as epoxy. The rigid insulation material 119 is brought up to the shoulder 110 of each pin 120 to form a thin insulating covering over the exposed cylindrical part of each pin 120, but not far enough to insulate the pins from the wire mesh 118 when the male 41 and female 94 connector parts are mated. The male connector part 41 also contains a thin circular disc 109 preferably of stainless steel which is coaxially bonded to the distal face of the said male connector part. The diameter of the disc 109 is slightly less than the distance between the two pins 120. The disc 109 acts as a rocket motor blast shield. One of the insulated electrical wires 113 is connected to the positive terminal of the battery 38 in FIG. 2 while the other remaining insulated wire is connected to the negative terminal of the battery at time of igniter firing.

Figure 7:
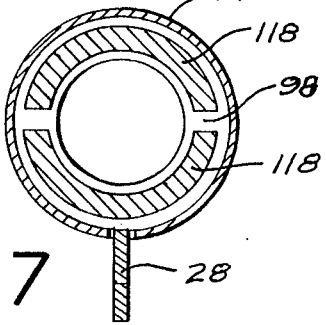
FIG. 7 is a fragmentary section view taken along line 7—7 of FIG. 6.

The preferred embodiment of the female connector part 94 is also shown in FIG. 6. The female connector part consists of a rocket motor igniter 95 with two electrical wires 96 each of which is soldered at 97 to a circular segment of fine copper wire mesh ribbon 118 with said wire mesh being imbedded and completely covered in a cylinder of elastic insulating material 98. FIG. 7 shows the configuration of the copper wire mesh circular ribbons 118 with each being of sufficient length as to be penetrated by one pin 120 of the male connector part 41 regardless of missile rotational orientation when inserted into the launcher guide rails 22 and 43 as indexed by the missile fins 62. The elastic material 98 is preferably RTV silicon rubber and the diameter of said elastic material cylinder is the same as the inner diameter of the missile body 61. The thickness of the elastic material 98 through which male connector part pins 120 must penetrate is just enough to allow the uninsulated part of said pins to contact the wire mesh 118. The wire mesh 118 is typically braided copper ground strap wire. A coaxial circular aperture 99 exists in the cylinder of elastic insulating material 98 which allows rocket motor exhaust to escape from the rear of the missile 60. The female connector 94 is bonded to the aft end of the rocket motor 81 and to the inner walls of the missile body 61, with the igniter 95 being inserted through the throat 88 (see FIG. 6) of the rocket motor. The bond material is preferably silicon rubber adhesive. A small piece of raw cotton is gently inserted through the rocket motor nozzle throat to form a nozzle plug 100. Wax 101 fills the void between the cotton plug 100 and the proximal end of the rocket motor 81; the said wax forming a flush face at said end with a groove in the wax to keep line 80 free. A small plug of plastic sealant 102 such as duct seal fills the groove 89 (FIG. 5) where line 80 turns to pass in front of the nozzle 88.

Small rectangular notches 103 are made around the periphery of the rocket body 61 proximal end and between the missile fins 62. These notches engage the missile restraint release cam 28 when the missile 60 is inserted in the launcher 20. In the preferred embodiment, there are four fins 62 and four notches 103.

The electrical diagram for the rocket launcher 20 and rocket propelled missile 60 is shown in FIG. 8. For the preferred embodiment, two 7.2 volt rechargeable nickel-cadmium batteries 38 are joined in parallel by means of a battery connector 130. A wire leading from the negative side of connector 130 is joined to one terminal of a 2 amp fuse 141 also contained in the hollow handle cavity 35 to the side of one of the batteries 38. The other terminal of fuse 141 is connected to the common terminal 131 of fire switch 32. The positive side of connector 130 is joined by means of a wire to the common terminal 132 of safe/arm switch 53. The normally closed terminal 133 of fire switch 32 is connected by wire to the front 135 and rear 136 sight lights, which are in parallel and are located in front sight 47 and rear sight 52, respectively. Also connected to the common terminal of fire switch 32 is a 12K ohm resistor 137 and an LED test light 51, which are in series, and this series circuit connects with one of the pins 120 in the male electrical connector part 41. The normally open terminal 134 of fire switch 32 is also connected by wire to this pin. The other male electrical connector pin 120 is connected by wire to end of the sight light parallel circuit 139 and this connection is connected by wire to the normally open terminal 140 of safe/arm switch 53.

Within the rocket propelled missile 60, the pins 120 provide a connection to the rocket motor igniter 95 through the female electrical part 94.

In operation, moving the safe/arm slide 54 to the arm position connects the common terminal of safe/arm switch 53 with its normally open terminal. Current will then flow through the sight lights 135 and 136 thereby illuminating them. We find the use of illuminated sights very valuable in low light conditions. If the male 41 and female 94 electrical connector parts are mated, a small amount of current will flow through the igniter. The small current flow will cause the LED test light 51 to be illuminated indicating a complete circuit through igniter 95. This current is insufficient to initiate the igniter 95.

Pulling the trigger 30 will cause the common terminal 131 of fire switch 32 to connect with the normally open terminal 134 of the said switch. This action disconnects the sight lights and LED test light circuits and puts the full power of the batteries 38 into the rocket motor igniter 95. This of course causes the missile 60 to leave the launcher 20.

OPERATION OF THE PREFERRED EMBODIMENTS

With reference to the figures, the rocket propelled missile is prepared for use by unscrewing the nose cap 68 from the rocket propelled missile 60 boat tail part 71 and inserting an ammunition cartridge 66 into the open end of the seamless steel tube 67. The nose cap 68 is then screwed onto the boat tail part 71 and the rocket propelled missile now contains an active warhead. Alternatively, a cartridge 66 could always reside within steel tube 67 since the said cartridge cannot be fired without electrical ignition of the rocket motor of an act which breaks or cuts the restraint line 80, followed by an act that allows the inertial mass 73 to slide forward with a force sufficient enough as to initiate the cartridge primer 65.

In more detail and with reference to FIG. 5, line 80 holds wire loop 79 in groove 90 of the rocket motor 81. The right angle bend to the left of wire loop 79 in relation to the drawing engages the shoulder 77 of inertial slide mass 73. As long as line 80 is uncut, inertial slide 73 cannot move forward to contact the ammunition primer 65 without deforming the wire or breaking off the shoulder 77. Both these events can only occur if the missile is dropped from a great height. Even so, the missile must impact on its nose and any such inadvertent warhead firing will propell the projectile 66 into the ground.

When line 80 is cut by rocket motor exhaust, the line is free to slide in the open space between rocket motor 81 and missile body 61. Wire loop 79 can no longer be retained in groove 90 and the wire will move forward such that the right angle wire bend to the left of wire loop 79 no longer engages the inertial slide shoulder 77, thus freeing inertial slide 73.

The integrity of line 80 can be examined at the proximal end of missile 60 since it is exposed to view. The integrity of line 80 attachment to wire loop 79 is accomplished by longitudinally shaking an unloaded missile for inertial mass 73 motion. Rocket propelled missile 60 examination, loading, and unloading is accomplished above water.

The rocket launcher 20 is prepared for insertion of the rocket propelled missile 60 by the rearward sliding of the safe/arm switch 54 to the "safe" indication followed by slidable insertion of said rocket propelled missile between the rocket launcher guide rails 43 and 22. The missile 60 can be initially inserted at any rotational orientation because the missile fins 62 engage the beveled distal ends 44 and 23 of the guide rails 43 and 22, which automatically index the missile in rotation for proper penetration of pins 120 into the wire mesh ribbons 118. The missile 60 is inserted until it reaches the limit of its rearmost travel. An audible "click" is heard and felt as the missile restraint/release cam 28 beveled end engages one of the rectangular notches 103 provided in the proximal end of missile body 61. With insertion near the rearward limit of missile travel, male connector pins 120 pierce the silicon rubber 98 of the female connector part 94 and contact the wire mesh ribbons 118 completing a portion of the electrical circuit between the batteries 38 and rocket motor igniter 95. The weapon is now loaded and is presented in an electrically safe condition. For safety reasons, depressing the trigger 30 in this condition will not fire the missile. The previous actions, with the exception of missile preparation, can be accomplished underwater.

A remarkable characteristic of the RTV rubber 98 is that any number of penetrations by connector pins 120 can be allowed through the same holes. The RTV is self sealing. Thus the same missile can be loaded and unloaded an indefinite number of times while still making good electrical contact between the pins 120 and the wire mesh ribbons 118 with no contamination of electrical contacts.

To fire the weapon, the weapon is pointed at the target and the safe/arm switch 54 is slid forward with the thumb to the "arm" indication. This action connects all electrical circuits between the batteries 38 and rocket motor igniter 95 through the firing switch 32. Simultaneously, the front sight 47 and rear sight 52 are illuminated together with an electrical continuity check light 51 at the proximal end of the launcher. When check light 51 is illuminated, electrical continuity exists between the male 41 and female 94 connector parts through the igniter 95, If this light 51 is not illuminated, a faulty electrical connection or short circuit exists. If no lights on the entire launcher are illuminated, batteries 38 are dead or else the fuse 141 is blown.

Depressing the trigger 30 will cause the missile restraint/release cam 28 to disengage the rectangular notch 103 in the missile body 61 just prior to closing the firing switch 32. Closing the firing switch 32 causes electrical current to flow from the batteries 38 to the rocket motor igniter 95. This will ignite the rocket motor 81 with the simultaneous burnthrough of the nylon line 80, which will unlatch warhead firing mechanism inertial mass 73 and allow it to slide within missile body 61. Thrust from the rocket motor 81 will propel the missile from the launcher 20 to the target. Upon impact with the target, the inertial mass 73 slides forward within the missile body 61 unitl the firing pin 74 initiates the warhead cartridge primer 65. The cartridge projectile is then expelled from the tube 67 and into the target by the resultant ignition of the said cartridge powder charge.

To remove a projectile from the launcher, the safe/arm slide 54 is moved to the "safe" position and the trigger 30 is depressed until the restraint/release cam 28 disengages from missile body notch 103. The missile 60 is then slid forward and removed from the launcher 20.

Fired missiles which miss their targets are not intended to be retrieved by the diver. They are expendable once fired, and because of its negative buoyancy, the missile will sink to the bottom, posing no future danger. After a period of time, water leakage through the fired rocket motor case (a paper product) will render the missile inert through corrosion.

Underwater reload of the weapon entails pointing the launcher upward after firing which allows any wax debris to leave the launcher. Another missile is then inserted into the pistol-like launcher.

In the course of developing the exterior shape for the missile, it became evident that missile accuracy was strongly dependent on the missile's stability margin (the distance between the missile's center of gravity and center of pressure divided by the missile's diameter), and the location of the missile's center of buoyancy relative to its center of gravity. Even with a high stability margin (a very stable missile), if the center of buoyancy was behind the center of gravity (C.G.), the missile arced downward during travel. Conversely, a center of buoyancy forward of the center of gravity caused the missile to arc upward. Placing the center of gravity near the center of buoyancy created a problem with cylindrical missile configurations since this placed the center of gravity too far aft for a satisfactory stability margin with the desired fin sizes (small fin size was desired to reduce the diameter of the launcher's fin guard and to reduce the possibility of fin damage due to careless handling). The non-obvious solution to the problem was to move the center of buoyancy forward. This was accomplished by incorporating a bulbous nose for the missile. By this we mean the diameter of the nose section is greater than the diameter of the body section, and the nose is characterized by a streamline shape. We prefer for the diameter of the bulbous nose to be about one and one half times the diameter of the missile body. The bulbous nose displaces more water and moves the center of buoyancy forward on the missile. Locating the missile center of gravity near this point provided the necessary static margin for accurate and stable underwater flight. The bulbous nose also provided more room for the warhead.

At the time of launch, the C.G. is slightly aft of the center of buoyancy, but by the time most of the fuel has been expended, the C.G. is sightly forward of the center of buoyancy.

Figure 9:
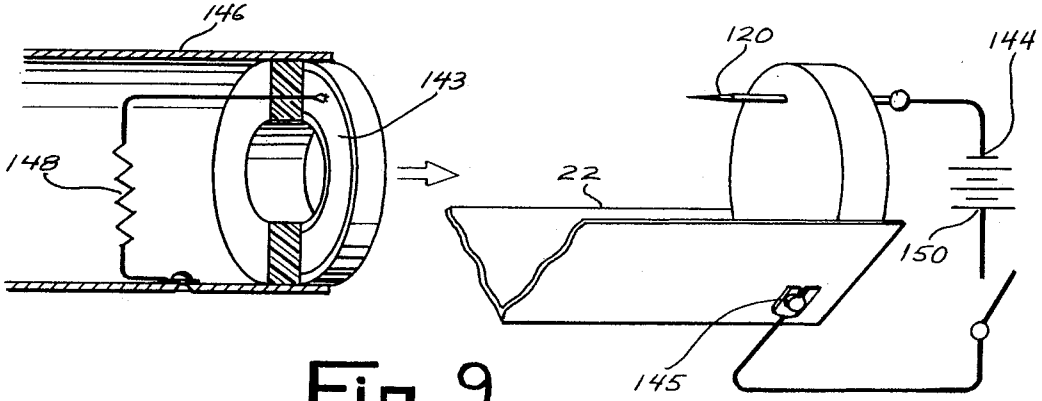
FIG. 9 is a fragmentary perspective view, partly in section, revealing the single pin and single wire mesh ribbon embodiments for electrically connecting the missile to the launcher.

While the above description contains many specific details, these should not be construed as limitations on the scope of the invention, but rather as an exemplification of one preferred embodiment thereof. Many other variations are possible, and for example, as shown in FIG. 9, the male and female connector embodiments could employ a single pin 120 and a single continuous wire mesh ribbon 143 providing a connection leading to one terminal 144 of the battery. The other battery terminal 150 could be connected by means of rivet 145 to a guide rail 22, which can be made electrically conductive. By use of an electrically conductive missile body 146 in contact with the guide rail 22, a complete conductive path is made through any electrical device 148 connected to the missile body and the wire mesh ribbon.

Figure 10:
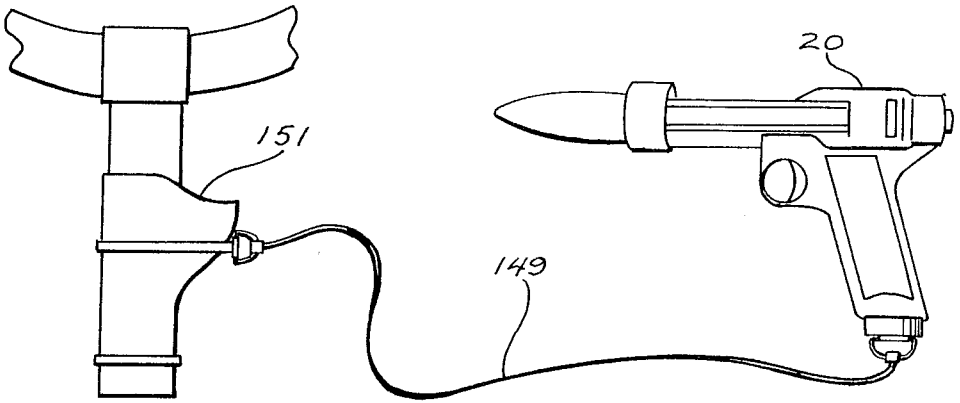
FIG. 10 is a plan view of our embodiment for attaching the rocket launcher to its holster.

As shown in FIG. 10, an embodiment of the rocket launcher 20 could consist of a line 149, one end of which is conveniently attached to the rocket launcher and the other end attached to the launcher's holster 151. This would allow weapon retrieval in the event the launcher is dropped.

Figure 11:
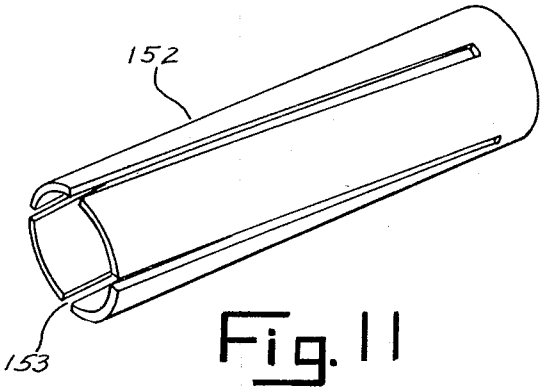
FIG. 11 is a perspective view of a tube with twisted fin slots for guiding the missile from the launcher.
Figure 12:
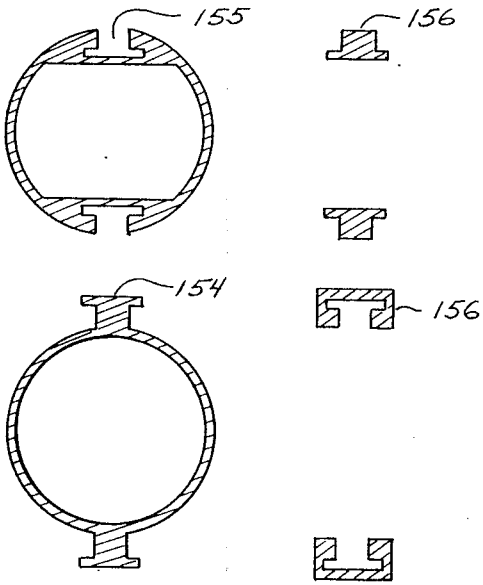
FIG. 12 illustrates the section views of the rocket propelled missile with a longitudinal foot or recess for engaging appropriate rail means.

The total number of guide rails used in our preferred embodiment is three and since our guide rails are of angular cross sections, a total of six surfaces guide the missile from the launcher. Any number of surfaces greater than two can be used for guiding the missile from the launcher or, as shown in FIG. 11, a tube 152 with or without fin slots 153 might be employed for the same purpose. Missile spin can also be provided within the launcher by twist in whatever means are employed for guiding the missile from its launcher. In addition, as shown in FIG. 12, at some sacrifice of clean lines, we could equip the missile with a longitudunal "foot" 154 or longitudinal recess 155, which would engage appropriate rail means 156 shown in FIG. 12.

The safe/arm switch is not an indispensable component for launcher 20 operation, but is provided in our preferred embodiment as an additional safety device. The electrical continuity check light is also not an indispensable component for launcher 20 operation nor are the illuminated sights.

Figure 13:
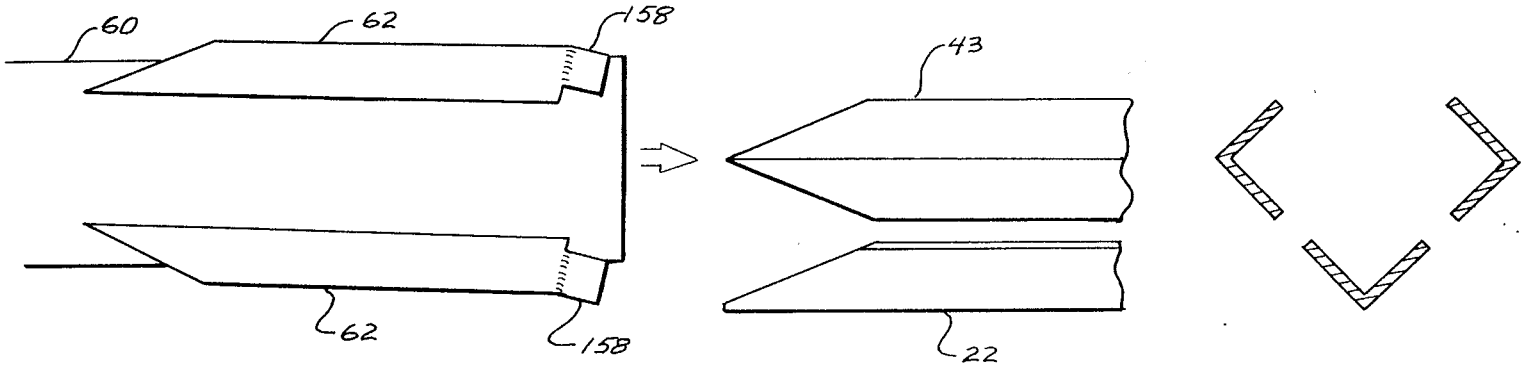
FIG. 13 shows fragmentary plan views of the rocket propelled missile with canted fins and fin tabs together with the launch rails and a launch rail section view.

Our preferred embodiment for the rocket propelled missile 60 employs four fins. However, any number of fins greater than one can be employed. As shown in FIG. 13, the fins can provide spin to the missile by canting the fins 62 with respect to the missile body 60 as was done in our preferred embodiment, or alternately, we can use angled fin tabs 158 singly, or in combination with fin cant.

We claim:

1. A hand held rocket weapon to be used as a protection against underwater marauders, comprising a pistol-like rocket launching device having a handle, a trigger adjacent the handle, and a rocket supporting body portion, said body portion having means for supporting and guiding a rocket motor propelled missile equipped with fins, said means for supporting and guiding also serving to automatically orient a missile for proper mechanical and electrical connections at the time of such insertion, and a mechanical missile restraint/release device for restraining the missile upon its insertion into said body portion, said restraint/release device releasing the missile upon said trigger being depressed by the user, and means actuated by said trigger for causing rocket motor ignition just after such missile release.

2. The hand held rocket weapon as recited in claim 1 wherein said rocket motor propelled missile has a warhead equipped with an impact type initiator, a ventilated inertial member equipped with a firing pin, and slidably mounted within the body of said missile, said inertial member being arranged to contact said initiator upon missile impact with an object, a restraint device preventing inertial member motion prior to rocket motor ignition, and spring means for holding said inertial member away from said warhead initiator until the missile impacts an object.

3. A hand held rocket weapon to be used as a protection against underwater marauders, comprising a pistol-like rocket launching device having a handle, a trigger adjacent the handle, and a body portion having means for supporting and guiding an electrically ignited rocket motor propelled finned missile that has been inserted into said body portion, a missile restraint/release device for restraining the missile upon its insertion into said body portion, said restraint/release device releasing the missile upon said trigger being depressed, said trigger also causing missile rocket motor ignition just after missile release, such ignition being brought about by an electrical energy source, and electrical continuity checking means for indicating that electrical continuity exists between said electrical energy source and said rocket motor.

4. The hand held rocket weapon as recited in claim 3 wherein said weapon is equipped with front and rear sights that can be electrically energized to give off visible light, said weapon also having a safe-arm switch operativley disposed for bringing about weapon readiness, said switch being electrically connected to said electrical energy source, and having means to accomplish electrical connections that bring about illumination of said front and rear sights at the time said switch is actuated to the arm position, such illumination of said sights serving to facilitate the aiming of the weapon in low light conditions.

5. A hand held rocket weapon to be used as protection against underwater marauders, comprising a pistol-like device having a handle, a trigger adjacent the handle, and a rocket-supporting body portion, said body portion having rail means for supporting and guiding a rocket motor propelled missile equipped with fins, a missile restraint/release device for automatically restraining the missile upon its insertion into the said body portion, said restraint/release device being operated by said trigger, to release the missile at the behest of the user, said rail means contacting the fins of the missile at the time of its insertion into said body portion so as to assure a proper orientation of the rocket missile for making mechanical and electrical connections.

6. The hand held rocket weapon as recited in claim 5 wherein fore and aft illuminated gunsights are provided for use in low light level conditions, which gunsights can be selectively energized by the user immediately prior to the firing of the rocket powered missile.

7. The hand held rocket weapon as recited in claim 5 wherein circuit means are furnished that when actuated, provide an indication of electrical continuity between an electrical power source and the rocket propelled missile.

8. The hand held rocket weapon as defined in claim 5 in which said rail means include three discrete devices, assembled in substantially parallel relationship, and serving to guide the rocket propelled missile immediately subsequent to the ignition of its motor.

9. The hand held rocket weapon as recited in claim 5 in which said trigger is connected to serve mechanical as well as electrical functions, with said trigger not only being connected to accomplish the mechanical release of the missile by said restraint/release device at the time the trigger is depressed, but also being connected to energize a firing circuit closely associated with the ignition of the rocket motor of the missile, the depressing of the trigger therefore accomplishing release of the missile immediately followed by ignition of the rocket motor.

10. A hand held rocket weapon to be used as protection against underwater marauders, comprising a pistol-like rocket launching device having a handle, a trigger adjacent the handle, and a rocket-supporting body portion, said body portion having rail means for supporting and guiding an electrically ignited rocket propelled missile equipped with fins, that has been inserted into said body portion, said rail means interacting with the fins of the missile so as to achieve a proper orientation of the missile at the time of its insertion into said pistol-like device, the missile having a rocket motor, and an electrical connector aft of said motor, said pistol-like device having an electrical component arranged to make contact with such connector at the time of the insertion of the missile into said body portion, said pistol-like device also having mechanical means for restraining the missile from premature dislodgment from a proper firing position, said trigger being connected to serve both mechanical and electrical functions, with the depressing of the trigger accomplishing a mechanical release of the missile, and the electrical function, occurring immediately after such release, accomplishing an ignition of the motor of the rocket weapon.

11. The hand held rocket weapon as recited in claim 10 wherein said rail means takes the form of a plurality of substantially parallel rails offering substantially no containment of gases liberated at the time of motor firing, thus eliminating recoil.

12. An underwater missile adapted to be fired from a hand held device, said missile having a body containing a rocket motor, a warhead having an impact sensitive initiator, and a firing mechanism for said warhead, said firing mechanism utilizing an inertial slide to which is affixed a firing pin, said inertial slide being movable in said body, and means for restraining said inertial slide from initiating said warhead except after the rocket motor has been ignited, said inertial slide moving to contact said initiator upon impact with an object.

13. The underwater missile as defined in claim 12 in which said inertial slide is ventilated, and restrained by spring means, said spring means being overcome to allow slide motion and impact with said impact sensitive initiator only if the missile has been launched, and an object has been struck by the missile.

14. The underwater missile as recited in claim 12 in which a bulbous nose is utilized on the front of the missile in order to improve accuracy and stability, said bulbous nose having a maximum diameter greater than the diameter of the missile body.

15. The underwater missile as recited in claim 12 in which said missile has a specific gravity greater than one, so that if it does not strike an object with sufficient velocity to initiate its warhead, it will sink to the bottom of the body of water, said warhead becoming water soaked after a period of time, rendering it harmless.

16. The underwater missile as recited in claim 12 in which said rocket motor is ignited by externally supplied electrical current reaching the motor through a conductor disposed around the periphery of the rocket motor nozzle, such that the motor can be selectively ignited by a hand held launcher at the behest of the user of the device.

17. The underwater missile as recited in claim 12 in which said rocket motor can be ignited by externally supplied electrical current, connector means disposed on the exterior of said missile, such that the motor can be selectively ignited by a hand held electrical source.

18. The underwater missile as recited in claim 17 in which said connector means utilizes male and female components that are interfitted when the missile becomes closely associated with the hand held electrical source.

19. A hand held launcher for a rocket propelled missile, said launcher having means for receiving and retaining a rocket motor propelled missile equipped with electrical conductor means disposed at a location adjacent the periphery of the rocket motor nozzle, said launcher having an electrical power supply, and means for penetrating the electrical conductor means of the missile, said launcher having trigger means for bringing about a release of the missile, and immediately thereafter, for closing the circuit between said power supply and the missile, to bring about ignition of the propulsion motor of the missile.

20. The hand held launcher for a rocket propelled missile as recited in claim 19 wherein fore and aft illuminated gunsights are provided, which can be selectively energized by the user immediately prior to the firing of the rocket powered missile.

21. A hand held launcher for a rocket propelled missile comprising a pistol-like device having a handle, a trigger adjacent the handle, and a missile supporting body portion, said body portion having rail means for supporting and guiding a rocket motor propelled missile equipped with fins, said rail means being available to interact with fins of the missile so as to achieve a proper orientation of the missile at the time of its insertion into said pistol-like device, said pistol-like device having an electrical component whose energization is controlled by said trigger, arranged to make contact with a connector on the missile at the time of insertion of the missile into said piston-like device, said trigger having means accomplishing both mechanical and electrical functions, the depressing of said trigger accomplishing a mechanical release of the missile, and the electrical function, occurring immediately after such release, accomplishing an ignition of the motor of the rocket, such that the rocket motor can be selectively ignited by the user depressing the trigger.

22. The hand held launcher for a rocket propelled missile as recited in claim 21 wherein said rail means include three discrete devices, assembled in substantially parallel relationship, and serving to guide the rocket missile immediately subsequent to the ignition of its motor.

* * * * *